US009730856B2

(12) United States Patent
Tamaki et al.

(10) Patent No.: US 9,730,856 B2
(45) Date of Patent: Aug. 15, 2017

(54) MASSAGE DEVICE AND CHAIR-TYPE MASSAGE APPARATUS EQUIPPED WITH THE MASSAGE DEVICE

(71) Applicant: DAITO ELECTRIC MACHINE INDUSTRY COMPANY LIMITED, Higashi-Osaka-shi, Osaka (JP)

(72) Inventors: Ken Tamaki, Higashi-Osaka (JP); Mikitaka Aoki, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi, Osaka (JP)

( * ) Notice: Subject to any disclaimer, the term of this patent is extended or adjusted under 35 U.S.C. 154(b) by 537 days.

(21) Appl. No.: 14/347,470

(22) PCT Filed: Oct. 16, 2013

(86) PCT No.: PCT/JP2013/078078
§ 371 (c)(1),
(2) Date: Mar. 26, 2014

(87) PCT Pub. No.: WO2015/015660
PCT Pub. Date: Feb. 5, 2015

(65) Prior Publication Data

US 2015/0216759 A1 Aug. 6, 2015

(30) Foreign Application Priority Data

Jul. 29, 2013 (JP) ..... 2013-156724

(51) Int. Cl.
*A61H 7/00* (2006.01)
*A61H 15/00* (2006.01)
*A61H 9/00* (2006.01)

(52) U.S. Cl.
CPC ..... *A61H 7/007* (2013.01); *A61H 15/0078* (2013.01); *A61H 9/0078* (2013.01);
(Continued)

(58) Field of Classification Search
CPC ..... A61H 7/007; A61H 7/004; A61H 7/003; A61H 2007/009; A61H 15/0078;
(Continued)

(56) References Cited

U.S. PATENT DOCUMENTS

2003/0199796 A1 10/2003 Yamazaki et al.
2004/0024335 A1* 2/2004 Marcantoni ..... A61H 15/0078 601/99

(Continued)

FOREIGN PATENT DOCUMENTS

CN 2284063 Y 6/1998
CN 1233460 A 11/1999

(Continued)

*Primary Examiner* — Justine Yu
*Assistant Examiner* — Kathrynn Lyddane
(74) *Attorney, Agent, or Firm* — Birch, Stewart, Kolasch & Birch, LLP

(57) ABSTRACT

A massage device for performing a kneading massage including paired left and right massage members, each having a treatment element, and a massage mechanism for operating at least one of the paired massage members to cause the treatment elements to move close to and away from each other in the horizontal direction to produce kneading actions. The massage member has an arm member extending substantially perpendicularly to the approaching/separating direction, and the treatment element is disposed at the front end of the arm member so that an extended line L extending along the protruding direction of the arm member passes through the interior of the treatment element.

4 Claims, 6 Drawing Sheets

(52) U.S. Cl.
CPC ..... *A61H 2007/009* (2013.01); *A61H 2015/0042* (2013.01); *A61H 2201/0149* (2013.01); *A61H 2201/1215* (2013.01); *A61H 2201/1427* (2013.01); *A61H 2201/1623* (2013.01); *A61H 2201/1654* (2013.01); *A61H 2201/1669* (2013.01); *A61H 2201/1678* (2013.01); *A61H 2203/0431* (2013.01); *A61H 2205/081* (2013.01); *A61H 2205/106* (2013.01)

(58) Field of Classification Search
CPC .... A61H 2015/0007; A61H 2015/0042; A61H 2015/005
See application file for complete search history.

(56) References Cited

U.S. PATENT DOCUMENTS

| | | | | |
|---|---|---|---|---|
| 2004/0171972 | A1* | 9/2004 | Shimizu | A61H 15/00 601/99 |
| 2005/0245851 | A1* | 11/2005 | Ferber | A61H 7/004 601/86 |
| 2006/0211962 | A1* | 9/2006 | Ferber | A61H 7/004 601/86 |
| 2007/0239090 | A1* | 10/2007 | Mitea | A61H 15/0078 601/112 |
| 2008/0077061 | A1* | 3/2008 | Dehli | 601/118 |
| 2010/0318008 | A1* | 12/2010 | Wu | A61H 7/007 601/134 |
| 2011/0160627 | A1* | 6/2011 | Huang | A61H 7/004 601/46 |
| 2011/0275968 | A1* | 11/2011 | Liu | A61H 7/007 601/134 |
| 2014/0163441 | A1* | 6/2014 | Chen | A61H 7/007 601/111 |
| 2015/0216759 | A1 | 8/2015 | Tamaki et al. | |

FOREIGN PATENT DOCUMENTS

| | | | |
|---|---|---|---|
| CN | 201840639 | U | 5/2011 |
| CN | 102231973 | A | 11/2011 |
| CN | 102641201 | A | 8/2012 |
| CN | 203634433 | U | 6/2014 |
| JP | 5-15560 | A | 1/1993 |
| JP | 11-206829 | A | 8/1999 |
| JP | 2003-310689 | A | 11/2003 |
| JP | 2004-337360 | A | 12/2004 |
| JP | 2005-230399 | A | 9/2005 |
| JP | 2007-14466 | A | 1/2007 |
| JP | 2009-50576 | A | 3/2009 |
| JP | 2012-165852 | A | 9/2012 |
| TW | M400319 | U1 | 3/2011 |

* cited by examiner

MASSAGE DEVICE AND CHAIR-TYPE MASSAGE APPARATUS EQUIPPED WITH THE MASSAGE DEVICE

TECHNICAL FIELD

The present invention relates to a massage device and a chair-type massage apparatus equipped with the massage device.

BACKGROUND ART

There is a heretofore known chair-type massage apparatus featuring a backrest having a built-in massage device for allowing a pair of right-side and left-side massage members to produce massaging actions.

The massage member provided in the massage device of this type comprises arm members extending outward from the interior of the backrest toward a user, and treatment elements (massage balls) disposed on the front-end sides of the arm members. The massage device is designed to move the treatment elements disposed at the front end of the massage member close to and away from each other in a horizontal direction, thereby giving a kneading massage to the back of a user (refer to Patent Literature 1, for example).

Moreover, the massage device disclosed in Patent Literature 1 is so configured that the massage member can be moved up and down in a vertical direction by a vertical movement mechanism (up-and-down mechanism) disposed inside the backrest. By making changes to the level of the treatment element while effecting a kneading massage, it is possible to give the kneading massage to a wider area of the back of a user in the vertical direction.

PRIOR ART REFERENCE

Patent Literature

Patent literature 1: Japanese Unexamined Patent Publication JP-A 2007-14466

SUMMARY OF THE INVENTION

Problems to be Solved by the Invention

In the conventional chair-type massage apparatus disclosed in Patent literature 1, the treatment element of the massage device has the shape of a circular plate, such as a wheel-like shape. In the interest of convenience in moving the massage device up and down, the treatment element is generally attached to the front-end side of the arm member, with its rotary shaft pointing in the horizontal direction.

In such a case where the rotary shaft of the treatment element points in the horizontal direction, the treatment element, while being rolled smoothly for easy movement in the vertical direction, is restrained against horizontal rolling motion. Therefore, "feelings of kneading" given to a body part to be treated are prone to lack variety. Furthermore, during a kneading massage, the treatment element rubbed strongly against the bumped-up to-be-treated part on the body surface as it moves reciprocally in the horizontal direction (or equivalently the direction in which the massage ball is NOT rotated), which resulted in a kneading feeling that is stronger than it needs to be.

The present invention has been devised in view of the circumstances as mentioned supra, and accordingly its object is to provide a massage device capable of providing a variety of non-boring kneading and massage feelings without causing a feeling of kneading that is stronger than required for a to-be-treated body part, and also a chair-type massage apparatus equipped with the massage device.

Means for Solving the Problem

In order to accomplish the above object, the following technical means is adopted for the implementation of the present invention.

A massage device pursuant to present invention comprises: a pair of right-side and left-side massage members, each having a treatment element; and a massage mechanism for operating at least one of the paired massage members in a manner such that the treatment elements are moved close to and away from each other in a horizontal direction to produce kneading actions. The massage member has an art member extending in a direction substantially perpendicular to the approaching/separating direction. The treatment element is disposed at a front end of the arm member in a manner such that an extended line extending along a protruding direction of the arm member passes through an interior of the treatment element.

It is preferable that the front end of the arm member is provided with a shaft body pointing in the protruding direction of the arm member, and that the treatment element is mounted for free rotation about the shaft body.

It is preferable that the treatment element is made rotatable in a direction substantially parallel to the approaching/separating direction of the arm member.

It is preferable that the arm member is configured to have branched front ends that extend upward and downward, respectively, and the branched upper and lower front ends are each provided with a treatment element.

It is preferable that the massage mechanism is designed to drive the base end of the arm member in a manner such that the front ends of the arm members are moved close to and away from each other in the horizontal direction.

A chair-type massage apparatus pursuant to the present invention comprises: a seat; a backrest disposed at the rear of the seat; and the above-described massage device that is mounted inside the backrest.

Advantageous Effects of the Invention

According to the massage device pursuant to the present invention and the chair-type massage apparatus equipped with the massage device, a variety of non-boring kneading and massage feelings can be imparted to a to-be-treated part.

MODES FOR CARRYING OUT THE INVENTION

Hereinafter, embodiments of the present invention will be described with reference to the drawings.

Figure 4:
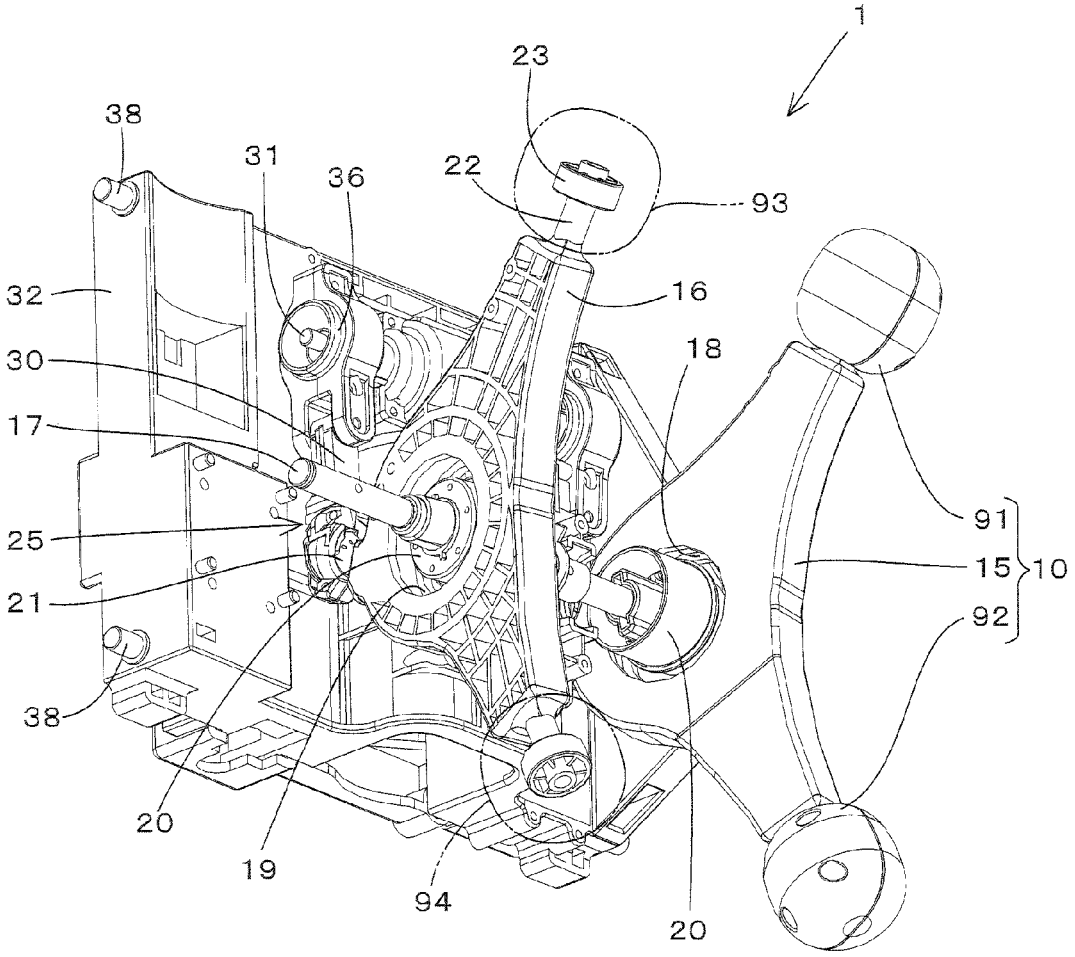
FIG. 4 is a lower perspective view of the massage device.
Figure 5:
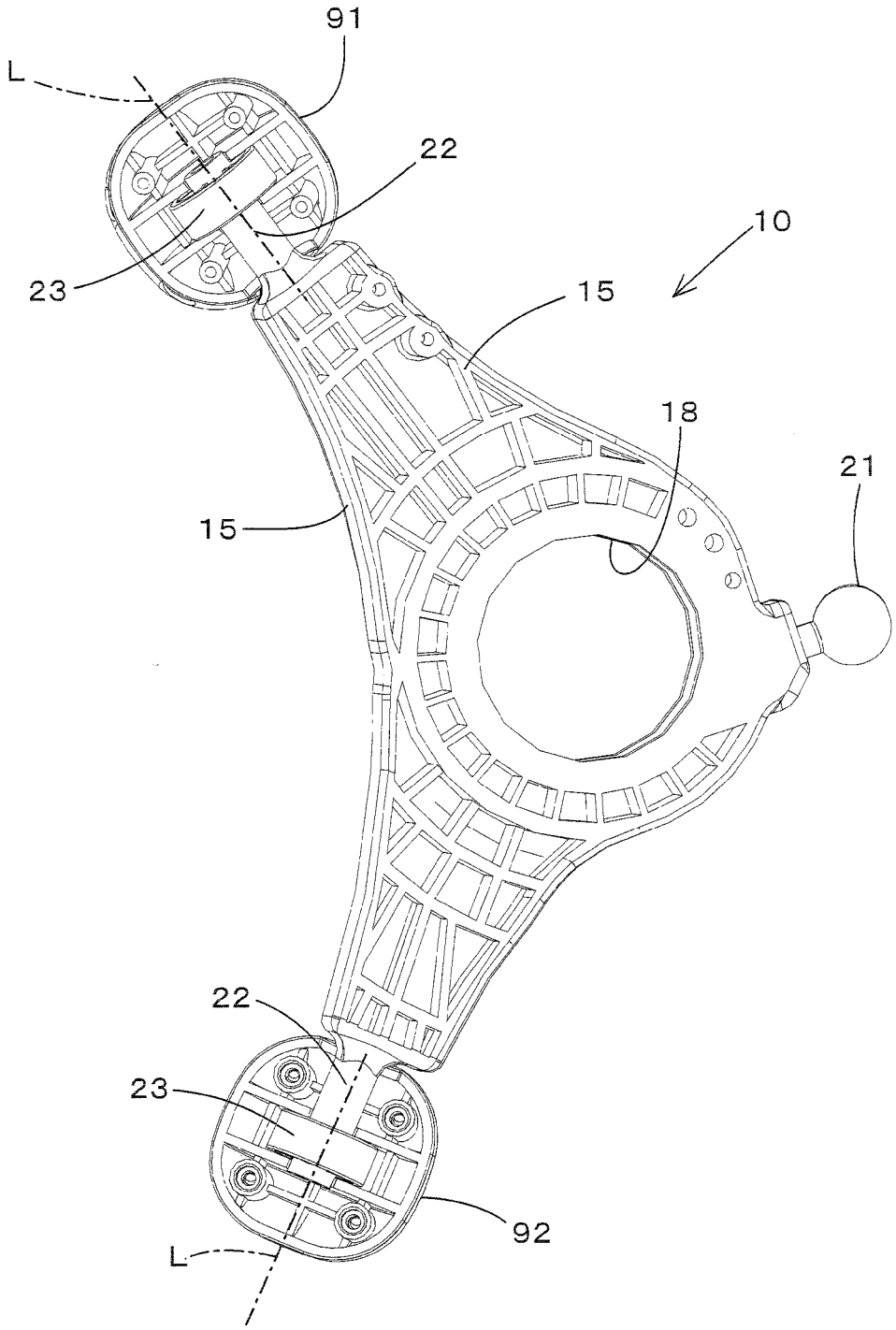
FIG. 5 is a side view showing a massage member.
Figure 6:
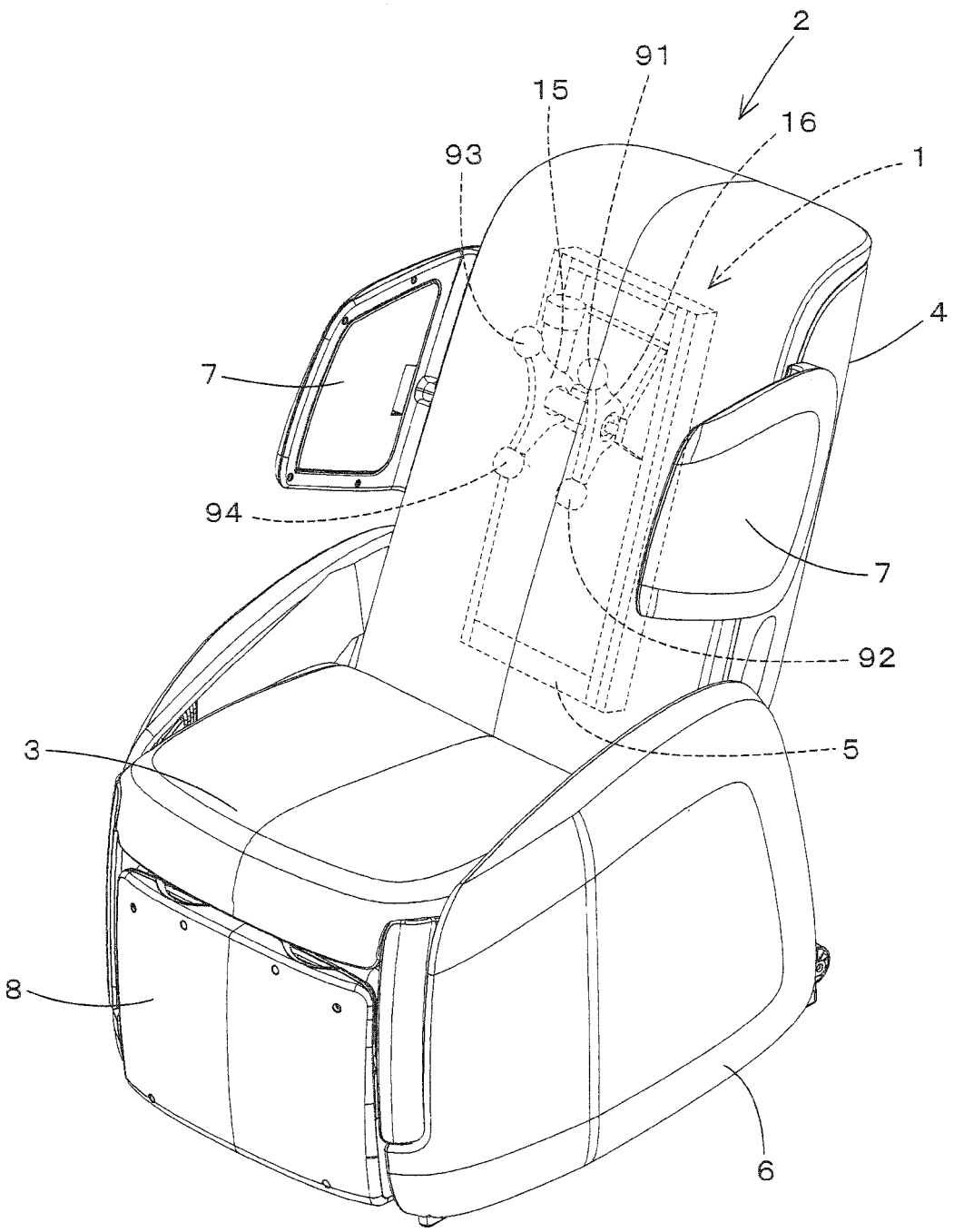
FIG. 6 is a perspective view showing a chair-type massage apparatus pursuant to the present invention.

FIGS. 1 to 5 show an embodiment of a massage device 1 pursuant to the present invention, and FIG. 6 shows an embodiment of a chair-type massage apparatus 2 equipped with the massage device 1.

As shown in FIG. 6, the chair-type massage apparatus 2 comprises a seat 3 for supporting the buttocks of a user from below and a backrest 4 mounted at the rear of the seat 3, and in addition, a massage device 1 and a vertical movement mechanism 5 for allowing the massage device 1 to move up and down in a vertical direction are mounted inside the backrest 4.

In the following description, where the massage device 1 is concerned, the direction of height of the backrest 4 in an upright state will be defined as a vertical direction, and, on the basis of the vertical direction, a right-left, or horizontal direction and a front-rear direction are defined for the sake of explanation of structure. The definitions of the above directions conform to a vertical direction, a horizontal direction, and a front-rear direction, respectively, based on the sight of a user sitting on the chair-type massage apparatus 2.

Figure 3:
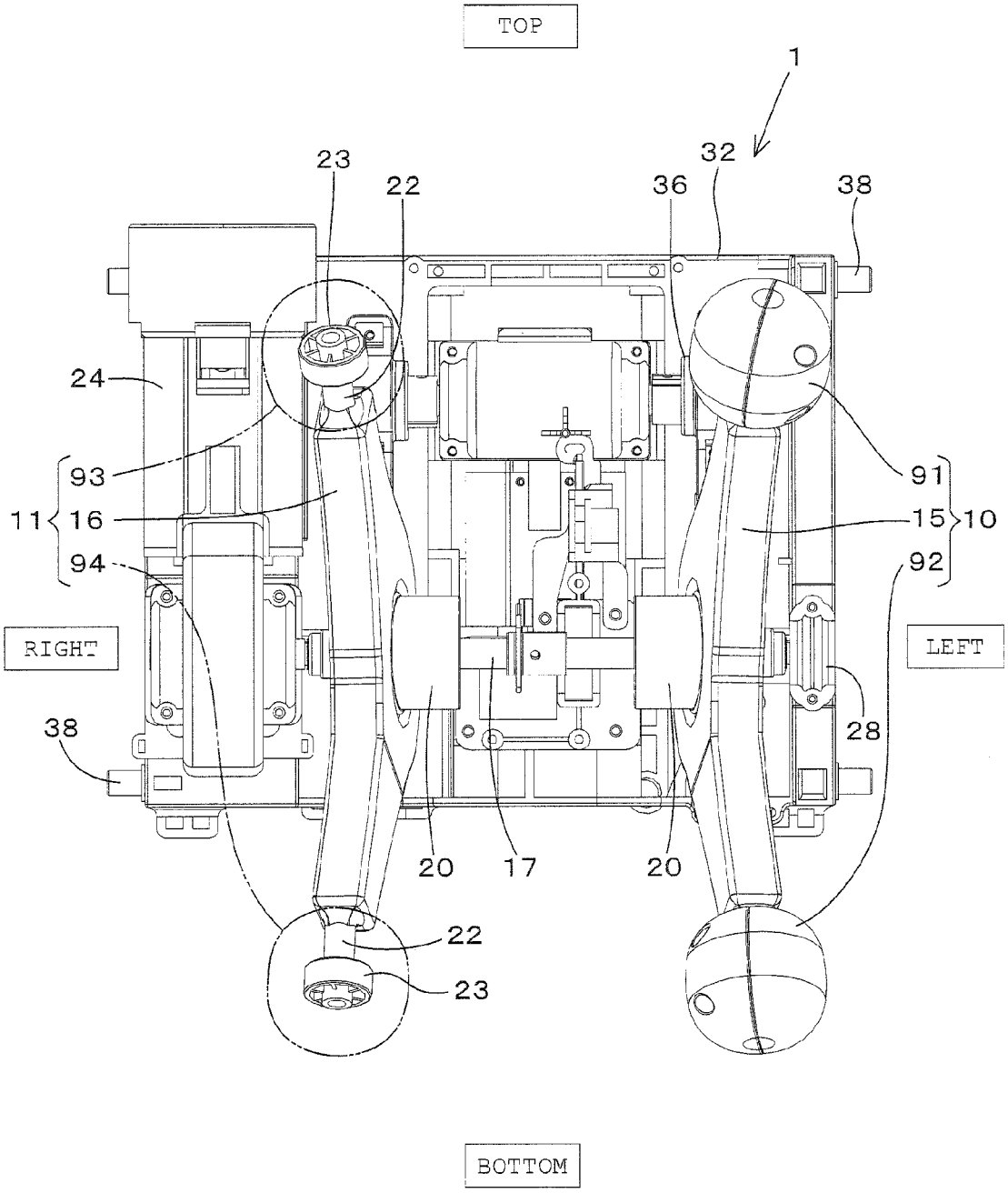
FIG. 3 is a front view of the massage device.

Moreover, in the description of the massage device 1, for example, in FIG. 3, a direction of from top to bottom of the drawing will be referred to as the vertical direction in explaining the device, a direction of drilling through the paper sheet with FIG. 3 printed on it will be referred to as the front-rear direction in explaining the device, and a direction horizontally of FIG. 3 will be referred to as a right-left direction or a widthwise direction in explaining the device. Note that, for example, in FIG. 3, the vertical direction and the horizontal direction as employed in the description of the present embodiment are specified.

A leg frame 6 for the placement of the chair-type massage apparatus 2 on a floor is disposed on both sides of the seat 3 of the chair-type massage apparatus 2 in the horizontal direction. The seat 3 is supported at a predetermined level by the leg frame 6.

The backrest 4 is, at its lower end, pivotally supported on the rear of the seat 3 or the rear of the leg frame 6 for free back-and-forth rocking motion. The backrest 4 can be shifted to a reclining position by a reclining mechanism such as a linear actuator mechanism disposed inside the leg frame 6. An airbag-type upper-arm massage unit 7 is disposed on both sides of the backrest 4 in the horizontal direction.

Moreover, a leg massage unit 8 capable of leg massage is disposed at the front of the seat 3. FIG. 6 shows the chair-type massage apparatus 2 in a state where the leg massage unit 8 is housed therein. However, it should be understood that these components as above described are merely shown by way of example of components that constitute the chair-type massage apparatus 2, and therefore there is no particular limitation to the presence or absence of them or the specifics of their mechanisms.

Figure 1:
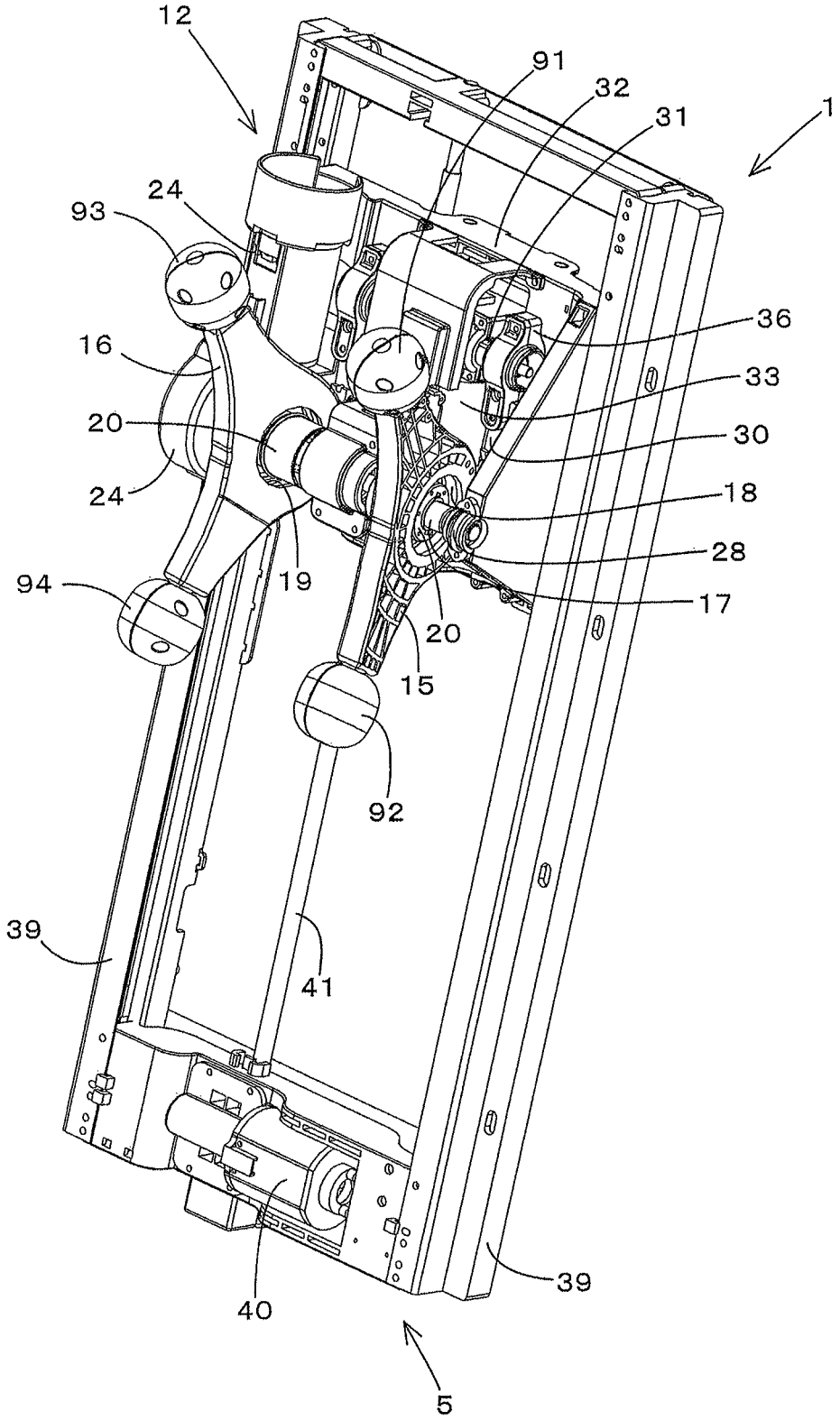
FIG. 1 is a perspective view showing a massage device and a mechanism for moving the massage device up and down.

As shown in FIG. 1, the massage device 1 comprises a pair of left and right massage members 10 and 11 with treatment elements 91 to 94 attached to their front-end sides, and a massage mechanism 12 for operating at least one of the paired massage members 10 and 11 in a manner such that the treatment elements can be moved close to and away from each other in the horizontal direction to produce kneading actions. The massage mechanism 12 includes a kneading driving section for giving a kneading massage to user s body over a range extending from the shoulder to the back, and from there to the waist (that is, a to-be-treated part). Moreover, in the massage device 1, a tapping driving section for giving a tapping massage to the shoulder/back/waist region of a user is provided independently of the kneading driving section as above described. In addition, the massage device 1 can be freely moved in the vertical direction by the vertical movement mechanism 5 described earlier.

To begin with, the massage device 1 will be described with reference to FIGS. 1 to 4.

The massage device 1 comprises a pair of right-side and left-side massage members, and a massage mechanism 12 for operating the paired massage members. More precisely, the massage member on the left side is designated as a left-side massage member 10, whereas the massage member on the right side is designated as a right-side massage member 11, and, there are provided a single left-side massage member 10 and a single right-side massage member 11 that are spaced apart in the horizontal direction by a predetermined distance.

Figure 2:
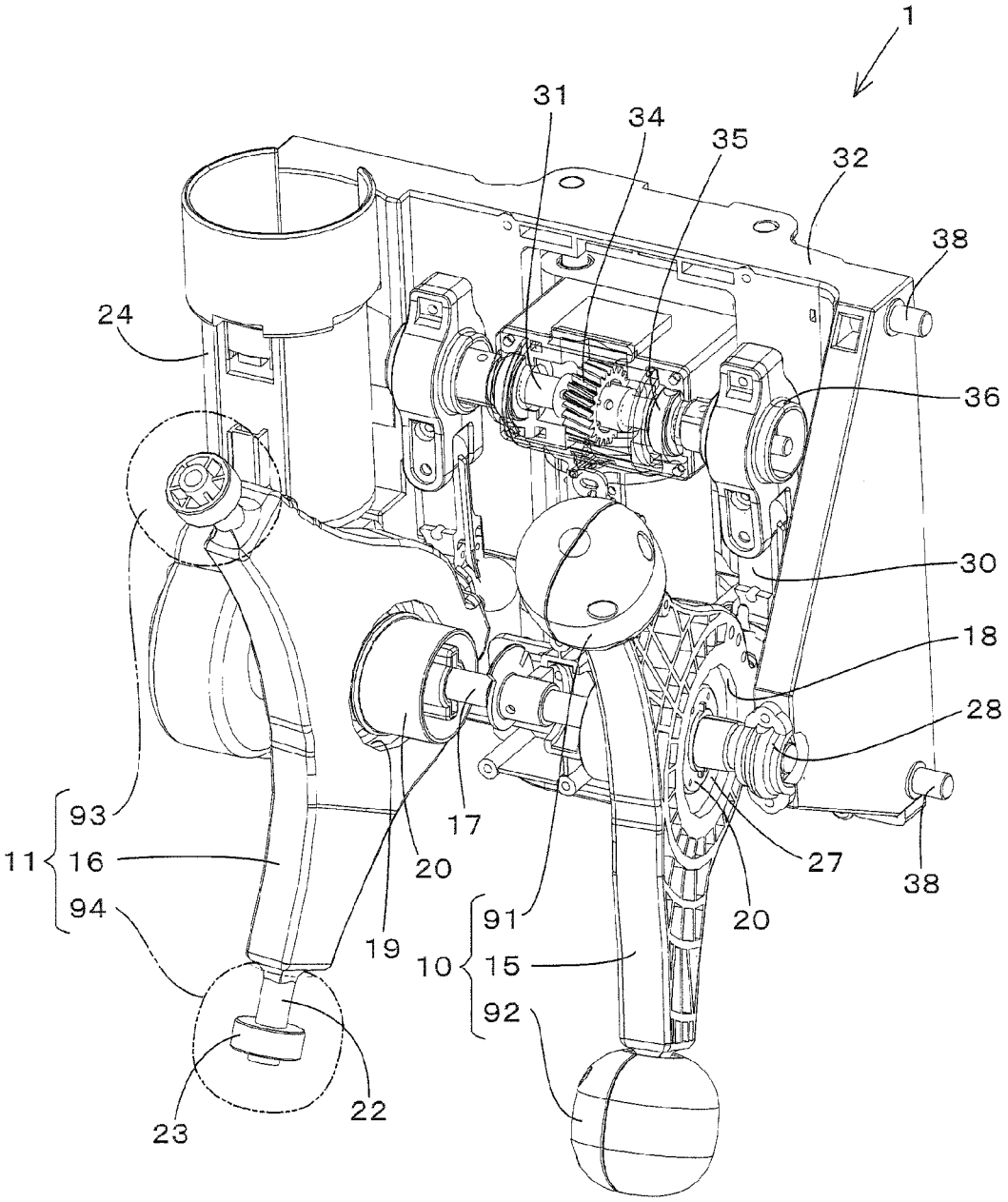
FIG. 2 is an upper perspective view of the massage device.

As illustrated in detail in FIG. 2, the above-described left-side massage member 10 has a left arm member 15 protruding in a direction from a base member 32 of the massage device 1 toward a user (frontward). The left arm member 15 is configured to have branched tips (extremities) protruding in two directions, namely upward and downward directions, respectively, and these branched upper and lower tips are each provided with a treatment element (the upper-left treatment element 91 and the lower-left treatment element 92).

Similarly to the left-side massage member 10, the right-side massage member 11 has a right arm member 16 protruding in the direction from the base member 32 of the massage device 1 toward a user (frontward). The right arm member 16 is configured to have branched tips (extremities)) protruding in two directions, namely upward and downward directions, respectively, and these branching upper and lower front ends are each provided with a treatment element (the upper-right treatment element 93 and the lower-right treatment element 94).

That is, as the left arm member 15 and the right arm member 16 are driven to move close to and away from each other, the upper-left treatment element 91 of the left arm member 15 and the upper-right treatment element 93 of the right arm member 16 are moved close to and away from each other in the horizontal direction, and also the lower-left treatment element 92 of the left arm member 15 and the lower-right treatment element 94 of the right arm member 16 are moved close to and away from each other in the horizontal direction, thereby giving a kneading massage to the to-be-treated part of user's back in a state of being held between the upper treatment elements 91 and 93, as well as between the lower treatment elements 92 and 94, in sandwich style.

FIG. 5 is an enlarged view of the left-side massage member 10, showing the details of the left arm member 15 employed in the left-side massage member 10. Next, the left arm member 15 shown in FIG. 5 will be described by way of example of the arm member of the present invention.

As shown in FIG. 5, the left arm member 15 has substantially the shape of a boomerang as viewed laterally (viewed from the left). Specifically, the left arm member 15 is a vertically-elongated platy member having one intermediate area in the vertical direction bent rearward. The upper-end side thereof protrudes forwardly and upwardly, and the lower-end side thereof protrudes forwardly and downwardly, relative to the vertically intermediate area.

Moreover, in the left arm member 15, the vertically intermediate area is made larger in width in the front-rear direction than the upper-end side and the lower-end side, and this wide intermediate area has an insertion hole 18, into which is inserted a first rotary shaft 17 which will hereafter be described, formed so as to pass through the left arm member 15 in the horizontal direction. In addition, the left arm member 15 is so shaped that the upper end protrudes forwardly and upwardly, and the lower end protrudes forwardly and downwardly, with respect to the intermediate area. The above-described treatment elements 91 and 92 are attached to the upper end and the lower end, respectively, of the left arm member 15.

Although the above description deals with the left arm member 15, the right arm member 16 also has constituent components that are constructed identically to those of the left arm member 15. The right arm member 16 is identical in member configuration with the left arm member 15, but the left and right arm members 15 and 16 are disposed in symmetric relation in respect of member arrangement.

As shown in FIG. 4, the above-described vertically intermediate area of the left arm member 15 is formed with the insertion hole 18, and similarly a vertically intermediate area of the right arm member 16 is also formed with an insertion hole 19. The insertion hole 18, 19 passes through the arm member 15, 16 in the horizontal direction to provide a substantially circular opening at each of the left side surface and the right side surface of the arm member, so that the first-rotary shaft 17 and an inclined rotation member 20 which will hereafter be described can be inserted into the arm member. Moreover, the rear end face of the arm member 15, 16 is formed with a restraint pin 21 for restraining co-rotation of the arm member 15, 16. The first rotary shaft 17, the inclined rotation member 20, and the restraint pin 21 will be described in detail later on.

As has already been described, the four treatment elements 91 to 94 are attached to the front ends of the arm members 15 and 16. The treatment elements 91 to 94 are attached to the two front ends (upper and lower front ends) of the arm member 15 and those of the arm member 16, respectively, and, each of the treatment elements 91 to 94 is so disposed that an extended line L extending along the protruding direction of the arm member (shown in FIG. 5) passes through the interior of the treatment element (91 to 94). Specifically, the front ends of the arm member 15, 16 are each provided with a shaft body 22 pointing in the protruding direction of the front end, and the treatment elements 91 to 94 are disposed so as to surround their respective shaft bodies 22.

While the treatment elements 91 to 94 are preferably made rotatable about the shaft body 22 of the arm member 15, 16, they may be disposed in a fixed state so as not to rotate about the shaft body 22 of the arm member 15, 16. In what follows, the massage device 1 of the present invention will be illustrated as employing a treatment element made rotatable about the front end of the arm member 15, 16.

As shown in FIG. 5, the treatment elements 91 to 94 are each a member having a substantially spherical or oval spherical outer appearance, and its surface is appropriately covered with a sheet made of a highly elastic material such for example as resin or hard rubber. The treatment elements 91 to 94 are each formed by combining a set of two components, which is obtained by dividing a spherical or oval spherical body into equal halves, in a face-to-face arrangement, and coupling the set of halved components together by means of screwing, mutual fitting, or otherwise.

Moreover, as has already been described, the treatment elements 91 to 94 are each disposed for free rotation about the shaft body 22 attached to the front end of the arm member 15, 16. Specifically, in the case as shown in FIG. 5, the shaft body 22 protrudes outward from the tip of the arm member 15 in the same direction as the protruding direction of the left arm member 15. For example, as for the upper-left treatment element 91, since the upper end of the arm member 15 extends forwardly and upwardly from the intermediate area, it follows that the shaft body 22 lies along the same direction as the protruding direction of the arm member 15 (an oblique direction from the lower rear side to the upper front side).

Intermediately of its axial ends the shaft body 22 is provided with a retaining portion 23 for locking the upper-left treatment element 91 to prevent it from coming off the shaft body 22. In providing such a retaining portion 23, the upper-left treatment element 91 is so disposed as to surround and hold the retaining portion 23 of the shaft body 22, and the treatment element is made rotatable about the axis of the shaft body 22 extending along the protruding direction of the arm member 15, 16. Accordingly, when the upper-left treatment element 91 is rotated about the shaft body 22, the direction of rolling of the upper-left treatment element 91 is substantially parallel to the approaching/separating direction of the arm members 15 and 16.

That is, it can also be said that the treatment elements 91 to 94 are each disposed in a position such that the extended line L extending from the tip of the arm member 15, 16 along the protruding direction of the arm member 15, 16 can pass through the interior of the treatment element (91 to 94).

In the case of adopting such treatment elements 91 to 94, a line extending from the vertically intermediate area toward the upper end of the arm member 15, 16, as well as a line extending from the vertically intermediate area toward the lower end of the arm member 15, 16, extends in a direction substantially perpendicular to the first rotary shaft 17 (the first rotary shaft 17 mounted in the massage mechanism 12, which will hereafter be described in detail) pointing in the horizontal direction (in other words, a direction intersected by the approaching/separating direction of the treatment elements 91 to 94, so that the treatment elements 91 to 94 can be rolled along the horizontal direction. Thus, during a kneading massage, the massage can be effected while rolling the treatment elements 91 to 94 along the surface of a to-be-treated part. This makes it possible to give, to a user, a massage feeling which is distinct from a massage produced simply by pressing the treatment elements 91 to 94.

That is, in a case where the treatment element is designed for turning movement about a horizontal axis, when the arm member is moved reciprocally from side to side, with the treatment element kept pressed against a to-be-treated part, then the treatment element may rub strongly against a bumped-up to-be-treated part on the body surface (to-be-treated part in bump form under which a bone exists, for example), thus causing pain to a user who receives the massage. Furthermore, in a case where the treatment element is of a type which is not rolled during a kneading massage, the treatment element merely slides over a to-be-treated part. In this case, feelings imparted to the to-be-treated part are prone to lack variety, wherefore the massage feelings for a user becomes boring.

In this regard, by the adoption of a structure in which the treatment elements 91 to 94 are rolled in the horizontal direction during a kneading massage as practiced in the massage device 1 of the present embodiment, even if there is a bumped-up to-be-treated part, the treatment elements 91 to 94 are able to go smoothly over the bumped-up to-be-treated part while rolling. Therefore, it never occurs that the treatment element rubs strongly against the to-be-treated part with consequent occurrence of pain to a user who receives the massage.

Moreover, when the treatment elements 91 to 94 are rolled over a to-be-treated part, stimuli are produced, such as a stimulus resulting from the rolling motion of the treatment elements 91 to 94 and a stimulus such as to wrap the to-be-treated part by the treatment elements 91 to 94, wherefore the variety of massage feelings imparted to the to-be-treated part can be increased. This makes it possible to give a variety of non-boring massage and kneading feelings to a user.

In addition, in many cases, a cover or the like is provided at the surface of the treatment element (91 to 94); that is, provided so as to lie between the treatment element (91 to 94) and a user. However, in the case of a treatment element of conventional design which is NOT rolled in the horizontal direction, the treatment element acts to rub against the cover, and consequently the cover may be broken due to long-term use. In this regard, in the case of the treatment elements 91 to 94 of the present embodiment, since the treatment elements 91 to 94 can be rolled along a kneading direction (the approaching/separating direction), it is possible to minimize the possibility of a problem such as a cover breakage as above described.

Next, a description will be given as to the massage mechanism 12 for rocking the treatment elements and the massage members 10, 11 thus far described.

Various types of driving means and power transmission mechanisms can be adopted for use as such a massage mechanism 12. In what follows, the massage device 1 of the present invention will be illustrated as employing a massage mechanism for effecting a massage by converting a rotational driving force produced by a kneading motor 24 and a tapping motor 33 into a kneading action and a tapping action by way of example of the massage mechanism 12.

Moreover, the massage mechanism 12 is designed to produce kneading actions by operating at least one of the paired right and left massage members. As such a massage mechanism 12, it is possible to adopt, for example, a construction for producing kneading actions by operating both of the right and left massage members in a manner such that they move close to and away from each other, or a construction in which one of the right and left massage members is fastened, and the other one is moved close to and away from the massage member in a fastened state to produce kneading actions. The following description deals with, as the massage mechanism 12 of the present embodiment, the construction for producing kneading actions by operating both of the right and left massage members in a manner such that they move close to and away from each other.

The massage mechanism 12 comprises: a kneading driving section for imparting a kneading motion to the left and right massage members 10 and 11; a tapping driving section for imparting a tapping motion to the left and right massage members 10 and 11; and a vertical movement mechanism 5 for permitting vertical movement of the massage device 1 (the left and right massage members 10 and 11, the kneading driving section, and the tapping driving section) in the interior of the backrest 4.

The kneading driving section, which gives a kneading massage to a to-be-treated part by moving the front ends of the arm members 15 and 16 close to and away from each other in the horizontal direction with respect to their base ends, is designed to impart a rocking motion to the front end by rocking the base end of the arm member 15, 16 in the horizontal direction.

Specifically, the kneading section has an inclined rotation member 20 inserted in the insertion hole 18, 19 of the massage member 10, 11 described previously. A first rotary shaft 17 is disposed centrally of the inclined rotation member 20 in the radial direction so as to pass through the inclined rotation member 20 in the axial direction. The first rotary shaft 17 is laid on the base member 32 while passing through the right and left inclined rotation members 20 continuously, with its axis pointing in the horizontal direction. The first rotary shaft 17 and the inclined rotation member 20 constitute the kneading driving section. Moreover, the kneading driving section includes a kneading motor 24 for rotatably driving the first rotary shaft 17, and a swing preventive mechanism 25 disposed at the rear of the massage member 10, 11, for restraining the arm member 15, 16 from rotating in response to the rotation of the first rotary shaft 17. For example, a universal coupling such as a ball joint can be adopted for use as the swing preventive mechanism 25.

The inclined rotation member 20, which is a cylindrical member attached to an intermediate part of the first rotary shaft 17, has an outer diameter greater than the axis diameter of the first rotary shaft 17. Moreover, the inclined rotation member 20 is disposed in coaxial relation to the first rotary shaft 17, and, the outer periphery of the inclined rotation member 20 is formed with a stepped part for the placement of a bearing 27.

The stepped part is inclined with respect to the axis of the inclined rotation member 20, and formed along a circular orbit around the axis. The above-described bearing 27 is attached to the stepped part by exploiting the difference in level. Moreover, the bearing 27 is fitted in the above-described insertion hole 18, 19 of the arm member 15, 16 for supporting the arm member 15, 16 for free rotation about the inclined rotation member 20.

The first rotary shaft 17 is a shaft member extending along the horizontal direction so as to pass through the center of the insertion hole 18 of the left-side massage member 11 and the center of the insertion hole 19 of the right-side massage member 11 as above described continuously. The first rotary shaft 17 is, at its right and left ends, rotatably supported on the base member 32 by shaft bearings 28. Moreover, he kneading motor 24 for driving the first rotary shaft 17 to rotate about its axis pointing in the horizontal direction is disposed at the right end of the first rotary shaft 17.

Specifically, a power transmitting member constructed of a worm gear is disposed at the drive shaft of the kneading motor 24, so that the first rotary shaft 17 can be rotatably driven by turning the power transmitting member by the kneading motor 24.

The swing preventive mechanism 25, which is intended to prevent the left-side massage member 10 and the right-side massage member 11 from rotating together with the first rotary shaft 17, is constructed by engaging the universal coupling such for example as a ball joint or a universal joint with the rear-end side of the massage member 10, 11 for retraining rotation of the massage member 10, 11 (co-rotation).

In the swing preventive mechanism 25, the co-rotation is restrained by the connection of the massage member 10, 11 to a second rotary shaft 31 of the tapping driving section via a link lever 30 of the tapping driving section that will hereafter be described. Specifically, the rear-end side of the arm member 15, 16 of the massage member 10, 11 is formed with the restraint pin 21 protruding backward. The restraint pin 21 has its front end (rear end) rounded in spherical form, and, the spherical end of the restraint pin 21 is engaged with the universal coupling disposed at the front end of the link lever 30 of the tapping driving section, thereby coupling the arm member 15, 16 to the tapping driving section for free rocking motion along the front-rear direction, the horizontal direction, and the vertical direction.

Accordingly, when the first rotary shaft 17 is rotated, even though the massage member 10, 11 is about to rotate in response to the rotation of the first rotary shaft 17, the arm member 15, 16 of the massage member 10, 11 is restrained against co-rotation with the first rotary shaft 17 by the swing preventive mechanism 25. Specifically, in the swing preventive mechanism 25 employing the universal coupling, since the arm member 15, 16 is allowed to move in the front-rear direction, the horizontal direction, and the vertical direction within a predetermined movable range, it follows that the arm member 15, 16 is able to rock, at its front-end side, up and down, from side to side, and back and forth at a certain degree of angle with respect to the base-end side.

The tapping driving section comprises: a second rotary shaft 31 disposed above the first rotary shaft 17 in parallel relation thereto, with its axis pointing in the horizontal direction; and a tapping motor 33 for rotatably driving the second rotary shaft 31.

Specifically, the drive shaft of the tapping motor 33 is connected to a gear 34 disposed centrally of the second rotary shaft 31 in the horizontal direction. Upon rotatably driving the tapping motor 33, a rotational driving force exerted by the motor is transmitted to the second rotary shaft 31 through the gear 34, thereby driving the second rotary shaft 31. Moreover, a shaft bearing 35 is disposed in that part of the second rotary shaft 31 located outside the gear 34 in the horizontal direction, so that the second rotary shaft 31 can be freely rotated about its axis pointing in the horizontal direction via the shaft bearing 35. In addition, a right, left eccentric driver 36 is disposed in that part of the second rotary shaft 31 located outside the shaft bearing 35 in the horizontal direction, and the right and left eccentric drivers 36 are eccentrically mounted with a phase difference of 180° with respect to the second rotary shaft 31. The link lever 30 (crankshaft) is disposed so as to extend downward from the right, left eccentric driver 36.

The eccentric driver 36, which is not axially aligned with the second rotary shaft 31, is eccentrically rotated about the axis of the second rotary shaft 31 by driving the tapping motor 33. Moreover, the lower end of the link lever 30 is coupled to an intermediate area of the arm member 15, 16 in the vertical direction (insertion hole 18, 19). Specifically, the restraint pin 21, which is disposed in a vertically intermediate area of the arm member 15, 16 (massage member 10 11), is coupled to the lower end of the link lever 30 via the universal coupling. The structure of coupling between the restraint pin 21 and the link lever 30 constitutes the swing preventive mechanism 25 employing the universal coupling as above described.

Accordingly, in the tapping driving section, upon driving the tapping motor 33, the eccentric driver 36 is eccentrically rotated about the axis of the second rotary shaft 31, thus causing the link lever 30 to move in the vertical direction to produce pushing-pulling actions. As a result, the left and right arm members 15 and 16 operate to rock the treatment elements 91 to 94 about the first rotary shaft 17 in small motions, thus causing the treatment elements 91 to 94 to produce tapping actions. Since the right and left eccentric drivers 36 are eccentrically mounted with a phase difference of 180° with respect to the second rotary shaft 31, it follows that the treatment element 91, 92 of the left-side massage member 10 and the treatment element 93, 94 of the right-side massage member 11 are moved oppositely in the back and forth direction, wherefore the left-side massage member 10 and the right-side massage member 11 produce tapping actions in an alternating manner.

It is noted that, although the rocking motions of the left and right arm members 15 and 16 occur alternately because of the arrangement of the right and left eccentric drivers 36 with a phase difference of 180°, the movements of the treatment elements 91 to 94 are not limited to those as above described. For example, in the right and left eccentric drivers 36, with the provision of a switching mechanism capable of bringing their phase difference to a zero level, it is possible to change the setting as to tapping actions (tapping pattern) in a manner such that the left and right arm members 15 and 16 can be rocked in synchronization with each other in the same direction.

Next, a description will be given as to the base member 32 for supporting the massage device 1 thus far described and the vertical movement mechanism 5 for allowing the base member 32 to move up and down in the vertical direction inside the backrest 4.

A backrest frame 37 is disposed inside the above-described backrest 4, and the vertical movement mechanism 5 is attached to the backrest frame 37. The vertical movement mechanism 5 comprises the base member 32 having the massage mechanism 12, and a guide roller 38 rotatably held on both sides of each of the upper and lower parts of the base member 32 in the horizontal direction, with its axis of rotation extended outward (rightward and leftward) in the horizontal direction. In addition, there is provided a pair of right and left guide rails 39 for guiding the guide roller 38 fitted therein for vertical movement. The guide rail 39 is incorporated in the backrest 4, with the direction of its length pointing in the vertical direction.

Moreover, in a location midway between the guide rails 39 is disposed a screw shaft 41 which can be rotatably driven by an up-and-down motor 40, and, the base member 32 has a built-in nut member (not represented graphically) which threadedly engages the screw shaft 41. Accordingly, as the screw shaft 41 is driven to rotate by operating the up-and-down motor 40, the nut member converts a force in the direction of rotation of the screw shaft 41 into a translational force, thus causing the base member 32, together with the massage mechanism 12, to move up and down in the interior of the backrest 4.

In this construction, a user sitting on the seat 3 with his/her back pressed against the backrest 4 is able to receive a massage over a wide body-part range extending from the shoulder to the back, and from there to the waist, by moving the massage mechanism 12 up and down.

Next, how a massage is to be performed by means of the massage member 10, 11 and the massage mechanism 12, in other words, a massage method pursuant to the present invention, will be explained with a particular emphasis on a kneading massage.

In the massage mechanism 12, through the operation of the above-described up-and-down motor 40 of the vertical movement mechanism 5, the base member 32 is moved up and down while being guided by the guide rails 39, thus causing the base member 32 (massage device 1) to move to a desired position on user's back. The massage device 1 becomes able to perform a kneading massage by driving the kneading motor 24 provided in the base member 32 staying in the desired position.

The first step to effect a kneading massage is to drive the kneading motor 24. Upon driving the kneading motor 24, the first rotary shaft 17 connected to the kneading motor 24 is rotated about its axis pointing in the horizontal direction, and correspondingly the inclined rotation member 20 attached to the first rotary shaft 17 in coaxial relation is rotated about its axis pointing in the horizontal direction.

Then, while the inclined rotation member 20 is rotated about its axis pointing in the horizontal direction, the massage member 10, 11 is subjected to a rotational driving force to rotate it about an axis pointing in the horizontal direction in response to the rotation of the inclined rotation member 20. However, the direction of rotation of the massage member 10, 11 is not the same as that of the inclined rotation member 20. That is, the massage member 10, 11, being attached to the stepped part formed with inclination on the surface of the outer periphery of the inclined rotation member 20 via the bearing 27, is rotated about an axis which is inclined with respect to the axis pointing in the horizontal direction. Therefore, the above-described massage member 10 is rotated about an axis inclined with respect to the horizontal direction.

Moreover, with use of the above-described swing preventive mechanism 25, the restraint pin 21 disposed on the rear-end side of the arm member 15, 16 is coupled to the universal coupling of the link lever 30, and thus the arm member 15, 16, while being able to rock, at its front-end side, up and down, from side to side, and back and forth at a certain degree of angle with respect to the base-end side, is not allowed to rock at a large angle. Therefore, the massage member 10, 11 is restrained against rotation with the inclined rotation member 20, and is allowed to move only in a direction such as to rock along the horizontal direction. As a result, the massage member 10, 11 is rocked, at its front-end side, in the horizontal direction with respect to the base-end side.

It is noted that, so long as the bearing 27 attached to the outer periphery of the left-side inclined rotation member 20 and the bearing 27 attached to the outer periphery of the right-side inclined rotation member 20 are oriented in line-symmetric relation to each other, the rocking direction of the left-side massage member 10 and the rocking direction of the right-side massage member 11 are reverse to each other.

That is, when the left-side massage member 10 operates to move the treatment elements 91 and 92 rightward, the right-side massage member 11 operates to move the treatment elements 93 and 94 leftward, with the consequence that the left and right treatment elements 91 and 93, as well as the left and right treatment elements 92 and 94, are moved close to each other, thereby allowing a to-be-treated part to be held between the treatment elements (91 to 94) in sandwich style. Moreover, when the left-side massage member 10 operates to move the treatment elements 91 and 92 rightward, the right-side massage member 11 operates to move the treatment elements 93 and 94 leftward, with the consequence that the left and right treatment elements 91 and 93, as well as the left and right treatment elements 92 and 94, are moved away from each other, thereby releasing the to-be-treated part. In this way, as the left and right treatment elements 91 and 93, as well as the left and right treatment elements 92 and 94, are moved close to and away from each other, the to-be-treated part is held between the treatment elements (91 to 94) in sandwich style intermittently, thereby giving a kneading action (kneading massage) to the to-be-treated part.

In the massage device 1 thus far described, the arm member 15, 16 extends in a direction substantially perpendicular to the approaching/separating direction of the four treatment elements 91 to 94. Since the treatment elements 91 to 94 are each rotated about an axis pointing in the extending direction of the arm member 15, 16, it follows that each of the treatment elements 91 to 94 can be readily rolled in the horizontal direction, and can therefore be moved smoothly in the horizontal direction. That is, as the arm members 15 and 16 are moved closer to and away from each other during a kneading massage, their treatment elements 91 to 94 are moved in the horizontal direction while being rotated about the shaft body 22 so as to roll over the surface of a to-be-treated part. This makes it possible to give, to the to-be-treated part, massage and kneading feelings that are distinct from rubbing massage produced by a non-rotatable treatment element, and thereby afford sophisticated and non-boring kneading feelings.

Furthermore, during a kneading massage, if the treatment element in a non-rotating state is moved reciprocally in the horizontal direction, the treatment element will rub strongly against a bumped-up to-be-treated part on the body surface, which may result in a kneading feeling which is stronger than it needs to be. In this regard, in the present invention, since the treatment elements 91 to 94 are moved reciprocally in the horizontal direction while being rotated, it never occurs that the treatment elements 91 to 94 rub strongly against the bumped-up to-be-treated part on the body surface. This makes it possible to give comfortable kneading feelings to the to-be-treated part consistently.

The embodiment disclosed herein should be considered in all respects as illustrative and not restrictive. The scope of the present invention is not defined by the foregoing description but defined by the scope of the appended claims, and all changes that come within the meaning and the range of equivalency of the claims are therefore intended to be embraced therein.

Moreover, although the above-described embodiment exemplified a four-ball type construction in which the paired left and right arm members 15 and 16 are each provided with upper and lower treatment elements (91 to 94), the present invention is not limited to the arm member of this type. The present invention is applicable also to a two-ball type construction in which the paired left and right arm members 15 and 16 are each provided with a single treatment element.

Furthermore, although the above-described embodiment exemplified the treatment elements 91 to 94 that are each a member having a substantially spherical or oval spherical outer appearance, the treatment elements 91 to 94 may be given different outer appearance. For example, the treatment elements 91 to 94 may be cylindrically or polygonally shaped.

In addition, although the above-described embodiment exemplified the case where the arm member 15, 16, the shaft body 22, and the retaining portion 23 are provided independently of one another, these components may be formed integrally in one piece.

EXPLANATION OF REFERENCE SYMBOLS

1 massage device
2 chair-type massage apparatus
3 seat
4 backrest
5 vertical movement mechanism
6 leg frame
7 upper arm massage unit
8 leg massage unit
10 left-side massage member
11 right-side massage member
12 massage mechanism
15 left arm member
16 right arm member
17 first rotary shaft
18 left-side insertion hole

19 right-side insertion hole
20 inclined rotation member
21 restraint pin
22 shaft body
23 retaining portion
24 kneading motor
25 swing preventive mechanism
27 bearing
28 shaft bearing
30 link lever
31 second rotary shaft
32 base member
33 tapping motor
34 gear
35 shaft bearing
36 eccentric driver
37 backrest frame
38 guide roller
39 guide rail
40 up-and-down motor
41 screw shaft
91 upper-left treatment element
92 lower-left treatment element
93 upper-right treatment element
94 lower-right treatment element

The invention claimed is:

1. A massage device comprising:

a right-side massage member and a left-side massage member, each massage member has two treatment elements and an arm member; and a massage mechanism for operating at least one of said paired massage members in a manner such that corresponding treatment elements are moved close to and away from each other in a horizontal direction to produce kneading actions, wherein a shaft extends through a base end of each of the arm members, wherein each arm member extends in a direction substantially perpendicular to an approaching/separating direction, wherein each said treatment element is disposed at a front end of the corresponding arm member in a manner such that an imaginary line extending from the shaft through the front end of the corresponding arm member passes through an interior of said treatment element, wherein the front end of each of said arm members is provided with two shaft bodies extending in different directions, wherein each said treatment element is mounted for free rotation about the corresponding shaft body, and wherein said massage mechanism drives in a manner such that the base end of the corresponding arm member rocks about a horizontal axis defined by the shaft extending through each of the arm members, and is designed to move corresponding shaft bodies close to and away from each other in the horizontal direction.

2. The massage device according to claim 1, wherein an axis of rotation of each said treatment element is substantially perpendicular to the approaching/separating direction of said arm member.

3. The massage device according to claim 2, wherein each said arm member is configured to have branched front ends that extend upward and downward, respectively, and the branched upper and lower front ends are each provided with said treatment element.

4. A chair-type massage apparatus comprising:

a seat;

a backrest disposed at a rear of the seat; and the massage device as set forth in claim 3, which is mounted inside said backrest.

* * * * *